US006370991B1

(12) United States Patent
Hsieh

(10) Patent No.: US 6,370,991 B1
(45) Date of Patent: Apr. 16, 2002

(54) PLIERS FOR USE IN NARROW SPACE

(76) Inventor: Shih-Kuei Hsieh, No. 367-1, Pei Yang Road, Feng Yuan, Taichung (TW)

( * ) Notice: Subject to any disclaimer, the term of this patent is extended or adjusted under 35 U.S.C. 154(b) by 0 days.

(21) Appl. No.: 09/727,441

(22) Filed: Dec. 4, 2000

(51) Int. Cl.[7] ..... B25B 7/00

(52) U.S. Cl. ..... 81/427.5; 81/393; 81/177.9

(58) Field of Search ..... 81/427.5, 385, 81/393, 415, 177.7–177.9, 177.85, 489, 177.6; 30/87–89, 191–193, 211, 250–251

(56) References Cited

U.S. PATENT DOCUMENTS 5,121,624 A * 6/1992 Haughian ..... 81/427.5 X

* cited by examiner

*Primary Examiner*—D. S. Meislin
(74) *Attorney, Agent, or Firm*—Troxell Law Office PLLC

(57) ABSTRACT

Pliers for use in a narrow space, including: a pair of neck sections which are pivotally connected with each other by a shaft rod and can be opened and closed; a pair of jaw sections located on one end of the neck sections in the same direction to define a pliers mouth; and two grips disposed at the other ends of the neck sections for a user's hands to hold and control the jaw sections to open or close. At least one of the grips is pivotally connected with a corresponding neck section, whereby the grip can be rotated about an axis parallel to a longitudinal direction of the pliers into different operation aspects and adapted to different operation sites.

5 Claims, 5 Drawing Sheets

PLIERS FOR USE IN NARROW SPACE

BACKGROUND OF THE INVENTION

The present invention relates to a hand tool, and more particularly to a pliers which can be converted into different operation aspects in accordance with different working sites. Therefore, the pliers can be used in various narrow spaces.

FIG. 1 shows a conventional pliers 10 including a pliers mouth 12 and two grips 14. A user can hold the grips to control the pliers mouth to open or close for clamping,a work piece. When operating such pliers, it can be hardly used in a narrow space.

Recently, an improved pliers has been developed as shown by FIGS. 2 to 4. Such pliers has a pliers mouth 15 not coaxial with the grips 16. In operation, such pliers can be used in a narrow space. However, the pliers mouth 15 and the grips 16 are kept in a fixed angle so that the pliers can be only used in a specific site and can be hardly adapted to various narrow spaces.

SUMMARY OF THE INVENTION

It is therefore a primary object of the present invention to provide a pliers which can be converted into different operation aspects in accordance with different working sites. Therefore, the pliers can be used in various narrow spaces.

The present invention can be best understood through the following description and accompanying drawings wherein:

DETAILED DESCRIPTION OF THE PREFERRED EMBODIMENTS

Figure 1:
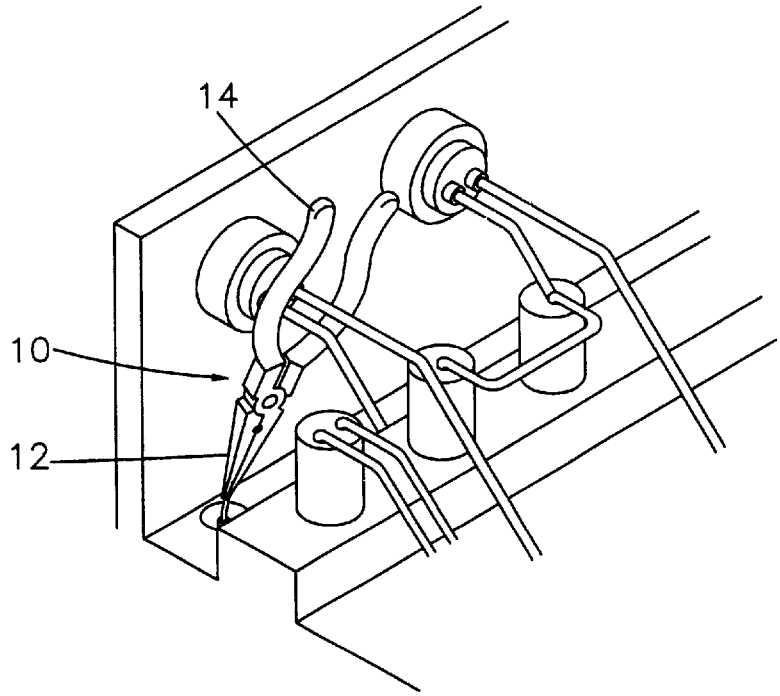
FIG. 1 PRIOR ART
FIG. 1 is a perspective view showing the structure and operation of a conventional pliers.
Figure 2:
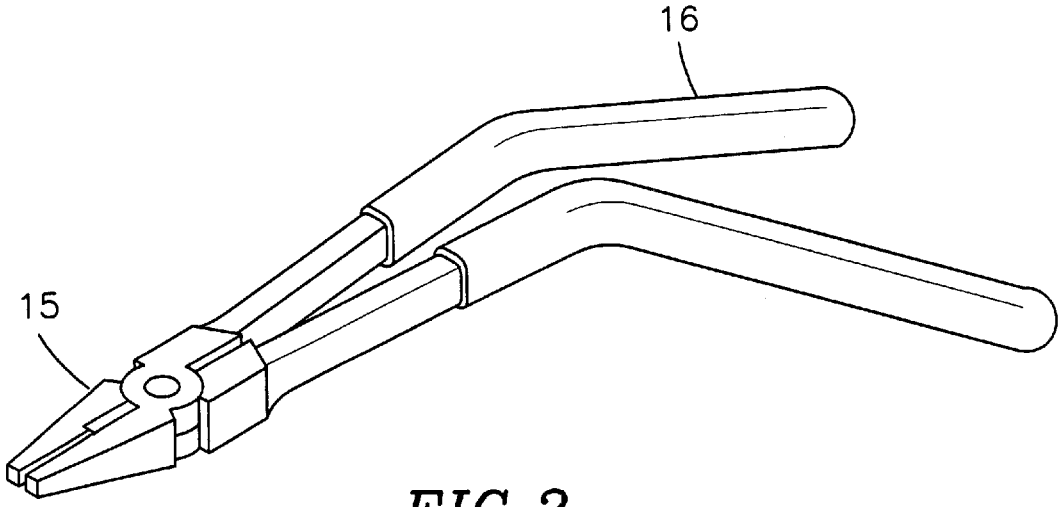
FIG. 2 PRIOR ART
FIG. 2 shows the structure of another type of conventional pliers.
Figure 3:
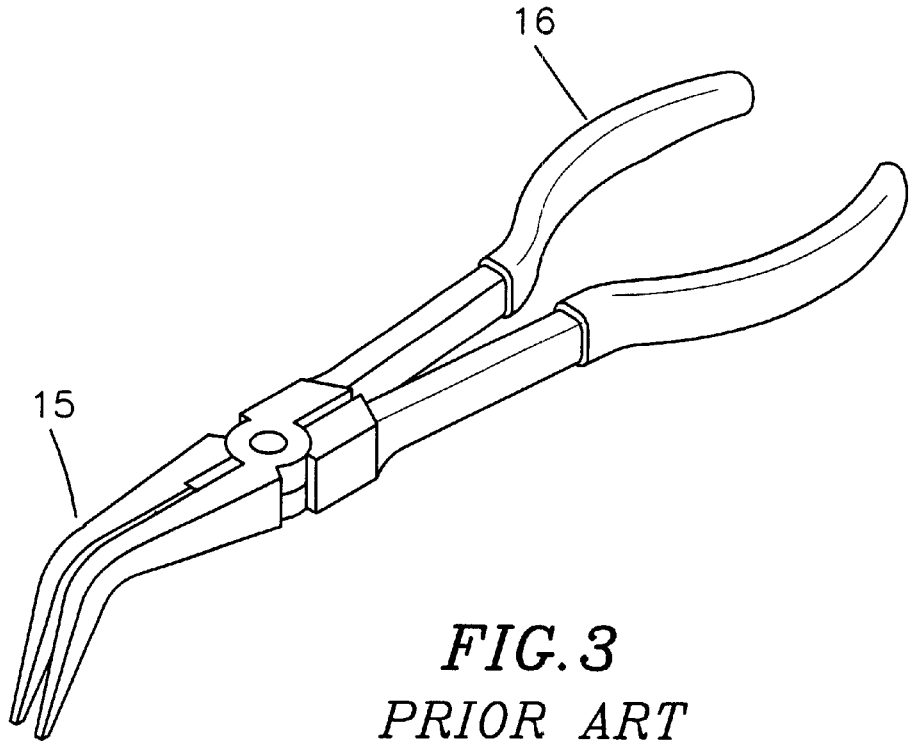
FIG. 3 PRIOR ART
FIG. 3 shows the structure of still another type of conventional pliers.
Figure 4:
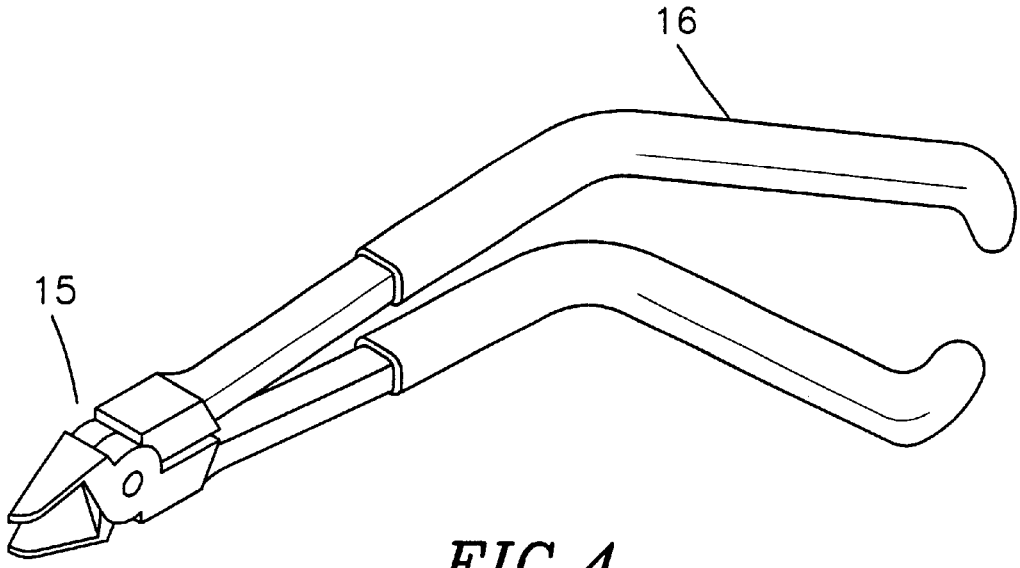
FIG. 4 PRIOR ART
FIG. 4 shows the structure of still another type of conventional pliers.
Figure 5:
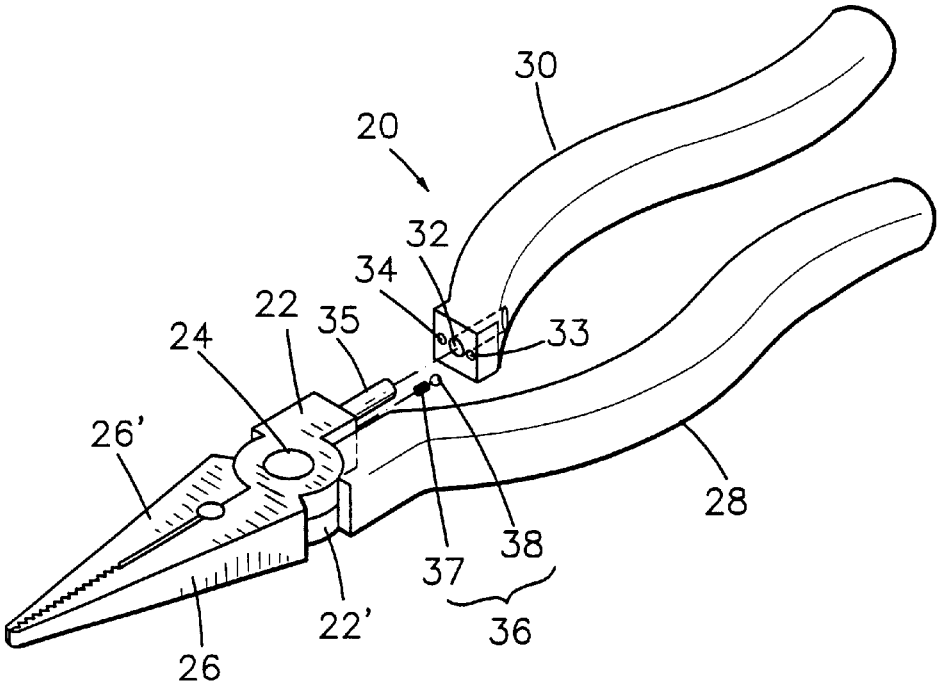
FIG. 5 is a perspective partially exploded view of a preferred embodiment of the present invention.
Figure 6:
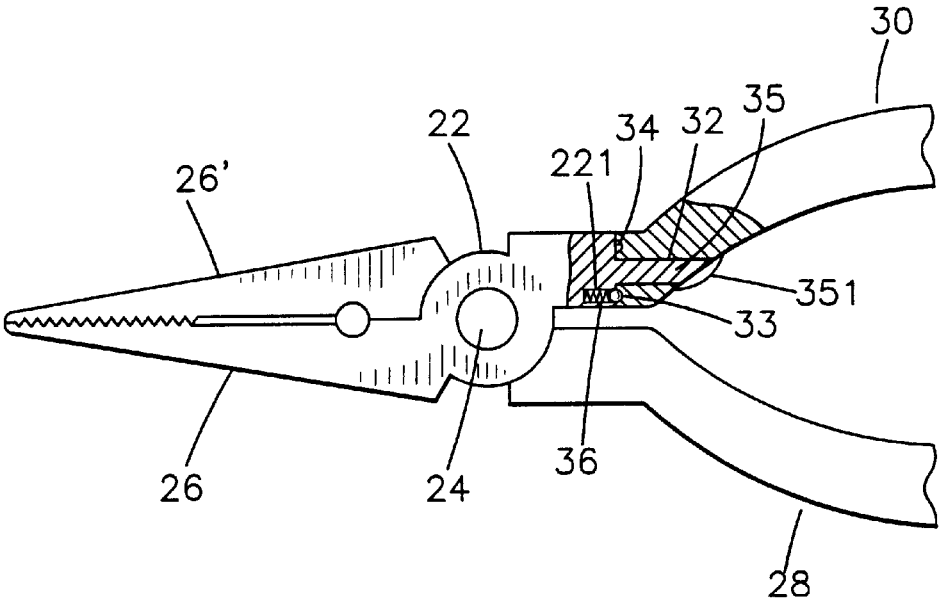
FIG. 6 is a partially sectional assembled view of the embodiment of FIG. 5.

Please refer to FIGS. 5 and 6. The pliers 20 of the present invention includes:

- a pair of neck sections 22, 22' overlapping each other and pivotally connected with each other by a shaft rod 24, whereby the neck sections 22, 22' can be opened and closed about the shaft rod 24;
- a pair of jaw sections 26, 26' which can be claws for clamping a work piece or blades for cutting a work piece, the jaw sections 26, 26' outward oppositely extending from one end of the neck sections 22, 22' in the same direction to define a pliers mouth; two grips 28, 30 which are arched bars respectively connected with the other ends of the neck sections 22, 22' for a user to hold, the grip 28 being directly integrally formed with the neck section 22', while the grip 30 being separately manufactured and connected with the neck section 22.
- a pivot shaft 35 outward extending from the other end of the neck section 22.

One end of the grip 30 is formed with an inward extending shaft hole 32 in which the pivot shaft 35 is fitted as shown in FIG. 6. The grip 30 is rotatable about the pivot shaft 35. The free end of the pivot shaft 35 is riveted to form a bulge section 351 and fixed with a certain member preventing the grip 30 from detaching.

- a resilient pressing member 36 including a spring 37 and a ball body 38 embedded in a dent 221 of the neck section 22 to resiliently press a locating section 33 of the pivot end of the grip 30 for locating the grip 30.

In this embodiment, the pivot shaft 35 is parallel to the longitudinal direction of the pliers.

It should be noted that the shaft hole 32, pivot shaft 35 and resilient pressing member 36 can be exchangeably disposed in the neck section 22 and the grip 30 and are not limited to what shown by the figures.

When the locating section 33 of the grip 30 is pressed and located by the resilient pressing member 36 as shown in FIG. 6, the grips 30, 28 are mirror symmetrical to each other about the longitudinal direction of the pliers and can be used as a conventional pliers.

Figure 7:
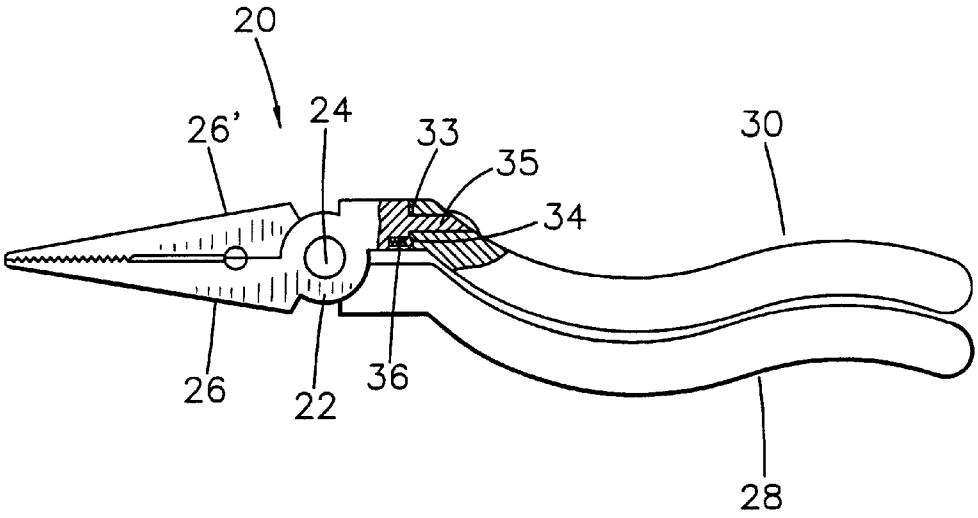
FIG. 7 is a view according to FIG. 6, showing that the grip is turned.
Figure 8:
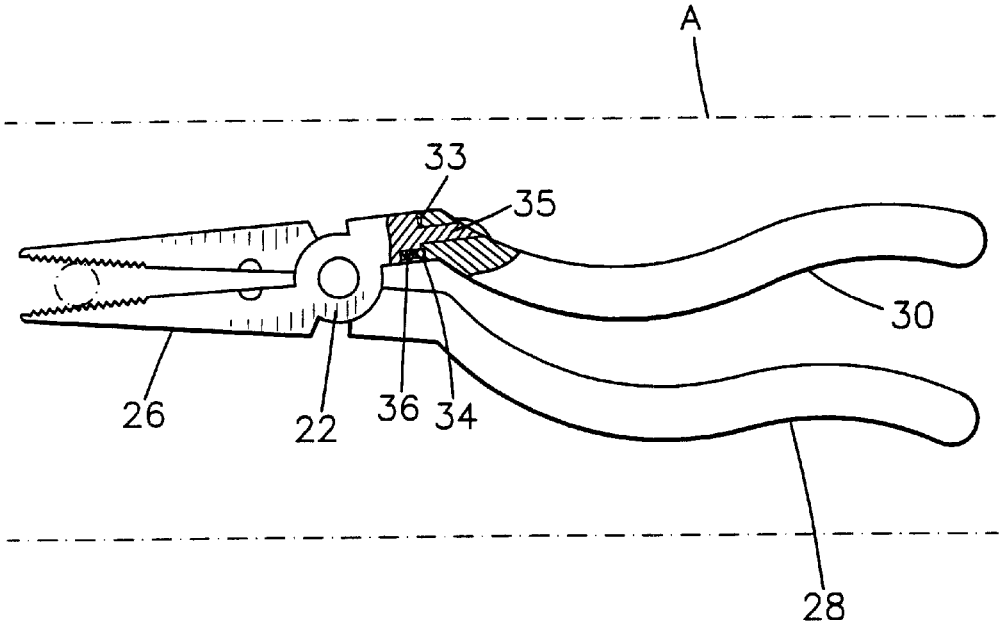
FIG. 8 is a view according to FIG. 7, showing the use of the pliers.

Referring to FIG. 7, the grip 30 can be turned to attach to the other grip 28 with the pressing member 36 pressing the other locating section 34. At this time, the volume occupied by the two grips is reduced and the pliers 20 can be easily used in a narrow space A as shown in FIG. 8.

Figure 9:
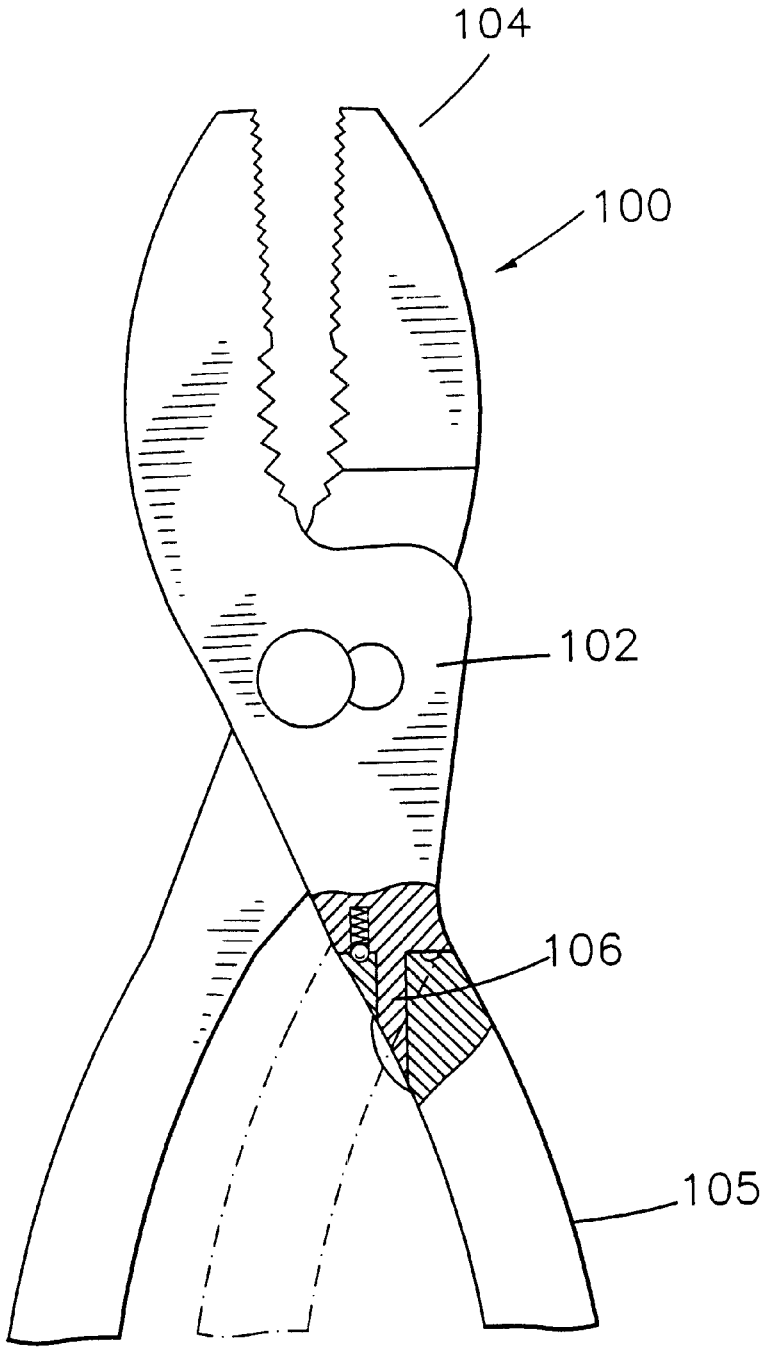
FIG. 9 is a partially sectional view of still another embodiment of the present invention.

FIG. 9 shows still another embodiment of the pliers 100 of the present invention, the distance between the two jaw sections 104 of the pliers can also be adjusted, at least one neck section 102 is pivotally connected with a grip 105 by a longitudinal pivot shaft 106.

Accordingly, the pliers of the present invention can be converted into different operation states and adapted to various kinds of narrow spaces.

The above embodiments are only used to illustrate the present invention, not intended to limit the scope thereof. Many modifications of the above embodiments can be made without departing from the spirit of the present invention.

What is claimed is:

1. Pliers for use in a narrow space, comprising:

a) first and second neck sections pivotally connected together, each neck section having a jaw section extending therefrom, whereby pivoting movement of the neck sections relative to each other causes movement of the jaw sections from and toward a closed position;

b) a first hand grip integrally formed with the first neck section, the first hand grip having a first curved portion;

c) a second hand grip pivotally connected to the second neck portion, the second hand grip having a second curved portion; and, d) a pivot device pivotally connecting the second hand grip to the second neck portion such that the second hand grip is movable between a first position in which the first and second curved portions are mirror images of each other when the jaw sections are in the closed position, and a second position in which the first and second curved portions are adjacent and parallel to each other when the jaw sections are in the closed position.

2. The pliers of claim 1 wherein the pivot device comprises:

a) a shaft hole in one of the second hand grip and second neck section; and, b) a pivot shaft extending from the other of the second neck section and second hand grip and pivotally engaging the shaft hole.

3. The pliers of claim 2 wherein the pivot shaft extends from the second neck section in a direction opposite from the associated jaw section.

4. The pliers of claim 1 further comprising a detent mechanism acting between the second neck section and the second hand grip to releasably hold the second,band grip in the first and second positions.

5. The pliers of claim 4 wherein the detent mechanism comprises:

a) two location indentations on one of the second hand grip and second neck section; and, b) a ball member located in the other of the second neck section and second hand grip, the ball member being biased into engagement with one of the locating indentations.

* * * * *